US010576512B2

(12) United States Patent
Ma et al.

(10) Patent No.: US 10,576,512 B2
(45) Date of Patent: Mar. 3, 2020

(54) WHEEL PRETREATMENT RACK

(71) Applicant: CITIC Dicastal CO.,LTD, Qinhuangdao (CN)

(72) Inventors: Qian Ma, Qinhaungdao (CN); Le Zhang, Qinhuangdao (CN); Yunpeng Du, Qinhuangdao (CN); Chuan Li, Qinhuangdao (CN); Shi Wang, Qinhuangdao (CN)

(73) Assignee: CITIC DICASTAL CO., LTD, Qinhuangdao, Hebei (CN)

( * ) Notice: Subject to any disclaimer, the term of this patent is extended or adjusted under 35 U.S.C. 154(b) by 133 days.

(21) Appl. No.: 15/842,129

(22) Filed: Dec. 14, 2017

(65) Prior Publication Data

US 2019/0030579 A1 Jan. 31, 2019

(30) Foreign Application Priority Data

Jul. 31, 2017 (CN) ..... 2017 1 06355152

(51) Int. Cl.

| | |
|---|---|
| ***B08B 13/00*** | (2006.01) |
| ***B08B 11/02*** | (2006.01) |
| ***B08B 9/30*** | (2006.01) |
| ***B08B 1/00*** | (2006.01) |
| *A47F 7/04* | (2006.01) |
| *A47F 5/00* | (2006.01) |
| *B08B 7/04* | (2006.01) |

(52) U.S. Cl.

CPC ..... *B08B 13/00* (2013.01); *B08B 1/008* (2013.01); *B08B 9/30* (2013.01); *B08B 11/02* (2013.01); *A47F 5/0006* (2013.01); *A47F 7/04* (2013.01); *B08B 7/04* (2013.01)

(58) Field of Classification Search

CPC ..... A61B 17/12113; A61B 17/12145; A61B 17/1215; A61B 17/12154; A61B 2017/00884; A61B 2017/1205; A61B 2017/12054; B62D 43/002; B08B 13/00; B08B 9/30; B08B 1/008; B08B 11/02; B08B 7/04; A47F 5/0006; A47F 7/04

See application file for complete search history.

(56) References Cited

U.S. PATENT DOCUMENTS 1,808,172 A * 6/1931 Leach ..... B66F 1/06 254/134
2,528,362 A * 10/1950 Hauta ..... B60C 25/02 157/1.17
2,635,795 A * 4/1953 White ..... B62D 43/002 224/42.24

(Continued)

*Primary Examiner* — Benjamin L Osterhout
(74) *Attorney, Agent, or Firm* — Calfee, Halter & Griswold LLP

(57) ABSTRACT

The application discloses an improved wheel pretreatment rack. The wheel pretreatment rack includes a hook, tripods, positioning slide blocks, positioning holes, a main rod, bearing rods, braces and positioning clamping jaws. Compared with the traditional wheel pretreatment rack, the improved wheel pretreatment rack in use has the advantages that the requirement of wheels having different sizes for the pretreatment rack is met by adjusting the positions of the bearing rods up and down, and the problems of drop, scratch and the like in the cleaning pretreatment process of the wheel may be effectively prevented by a wheel three-point-fixing mode.

3 Claims, 3 Drawing Sheets

(56) References Cited

U.S. PATENT DOCUMENTS

| | | | | | |
|---|---|---|---|---|---|
| 5,025,662 | A * | 6/1991 | Hultberg | G01M 1/045 | 73/459 |
| 5,064,334 | A * | 11/1991 | Cooley | B66C 1/24 | 212/238 |
| 5,195,370 | A * | 3/1993 | Hultberg | G01M 1/045 | 73/459 |
| 5,871,327 | A * | 2/1999 | McWha | B60B 29/00 | 224/42.12 |
| 5,927,931 | A * | 7/1999 | Raben | B66F 9/18 | 414/608 |
| 2007/0182115 | A1* | 8/2007 | Groomes | B60B 29/002 | 280/79.4 |
| 2015/0343863 | A1* | 12/2015 | Sotgiu | B60C 25/0578 | 157/1.24 |
| 2016/0236729 | A1* | 8/2016 | Jorgensen | B62D 43/10 | |

* cited by examiner

WHEEL PRETREATMENT RACK

CROSS-REFERENCE TO RELATED APPLICATIONS

This application claims priority to Chinese Patent Application No. 2017106355152, filed on Jul. 31, 2017, which is hereby incorporated by reference in its entirety.

TECHNICAL FIELD

The present application relates to the field of aluminum alloy wheels, specifically to a motor vehicle wheel pretreatment cleaning line rack.

BACKGROUND ART

In order to ensure the properties of wheels can meet the requirements for safety and other properties of motor vehicles, various large wheel manufacturers have strengthened research and development efforts to wheel development and production, and particularly put a lot of efforts into coated surface treatment. Practice has proved that the pretreatment before coating of wheels has important influence on film properties of the wheels, and whether pretreatment racks are appropriate also directly influences whether the pretreatment of wheels can achieve expected effects.

There are two most common pretreatment racks at present, wherein one rack is a hook-like rack hanging the central hole of a wheel, which facilitates relative displacement of the wheel under the impact of water flow in pretreatment, thereby scratching the central hole or the rim; and the other common rack supports the bead seat of the wheel by adopting braces, which greatly restricts the size of the wheel; the too large or too small wheel may drop in pretreatment, thereby seriously influencing safety production.

SUMMARY OF THE INVENTION

The present application is aimed at providing an improved wheel pretreatment rack. The rack may effectively fix a wheel thereon to effectively prevent the wheel from dropping in pretreatment, avoid scratching the wheel and be suitable for cleaning pretreatment of various common sized wheels.

An improved wheel pretreatment rack includes a hook, tripods, positioning slide blocks, positioning holes, a main rod, bearing rods, braces and positioning clamping jaws, wherein the main rod is connected with two tripods, the main rod is connected with two bearing rods via the positioning slide blocks in the direction perpendicular to planes determined by the tripods, the positioning slide blocks are fixed on the main rod by inserting the positioning clamping jaws into the positioning holes, the hook is arranged at the top of the main rod, and each tripod is connected with two braces in the direction perpendicular to plane determined by the tripod.

In a preferred aspect of the present application, the radii of the positioning holes are 8-10 mm.

In a preferred aspect of the present application, the distance between every two positioning holes is 5-10 mm.

In a preferred aspect of the present application, the front sections of the bearing rods tilt upward 125-135 degrees, the front sections means one ends which are not connected with the main rod.

The bearing rods are connected with the main rod via the positioning slide blocks, the positions of the bearing rods can be adjusted by moving the positions of the positioning slide blocks up and down according to the sizes of different wheels, and the bead seat of a wheel is placed on the braces connected with the tripods by hanging the center hole of the wheel on the bearing rods, so that the wheel is fixed and prevented from dropping in treatment.

Compared with the traditional wheel pretreatment rack, the present application in use has the advantages that the requirement of wheels having different sizes for the pretreatment rack is met by adjusting the positions of the bearing rods up and down, and the problems of drop, scratch and the like in the cleaning pretreatment process of the wheel might be effectively prevented by a wheel three-point-fixing mode.

BRIEF DESCRIPTION OF DRAWINGS

The implementation scheme of the present application will be described in detail below in combination with the accompanying drawings.

In which, 1—hook, 2—tripod, 3—positioning slide block, 4—positioning hole, 5—main rod, 6—bearing rod, 7—brace, 8—positioning clamping jaw.

DETAILED DESCRIPTION OF THE INVENTION

A rack provided by the present application will be further described in detail below in combination with the accompanying drawings.

Figure 1:
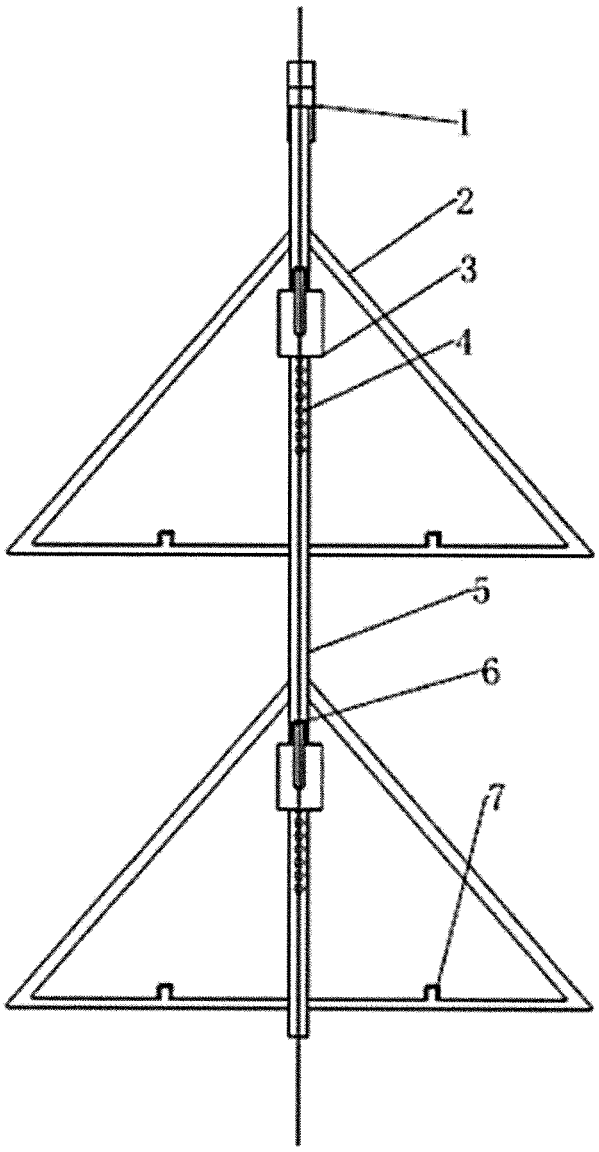
FIG. 1 is a front view of an improved wheel pretreatment rack device of the present application.
Figure 2:
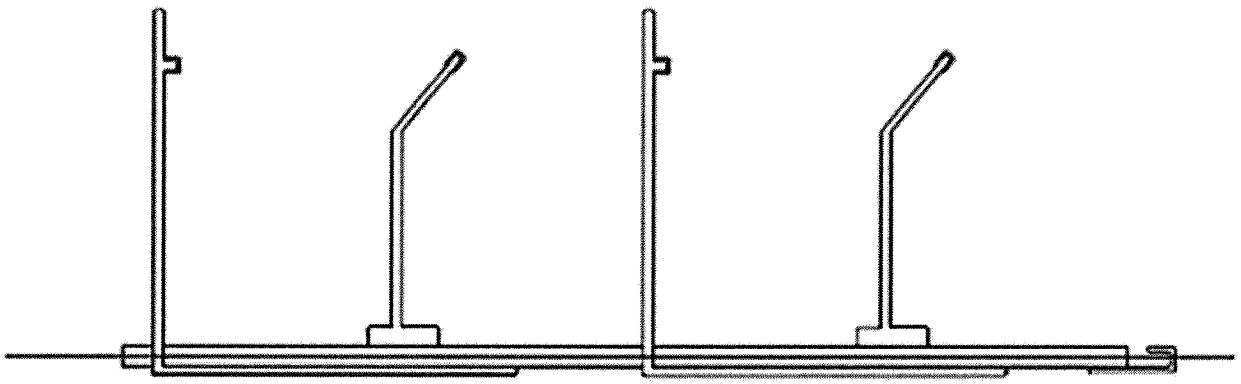
FIG. 2 is a side view of the improved wheel pretreatment rack device of the present application.
Figure 3:
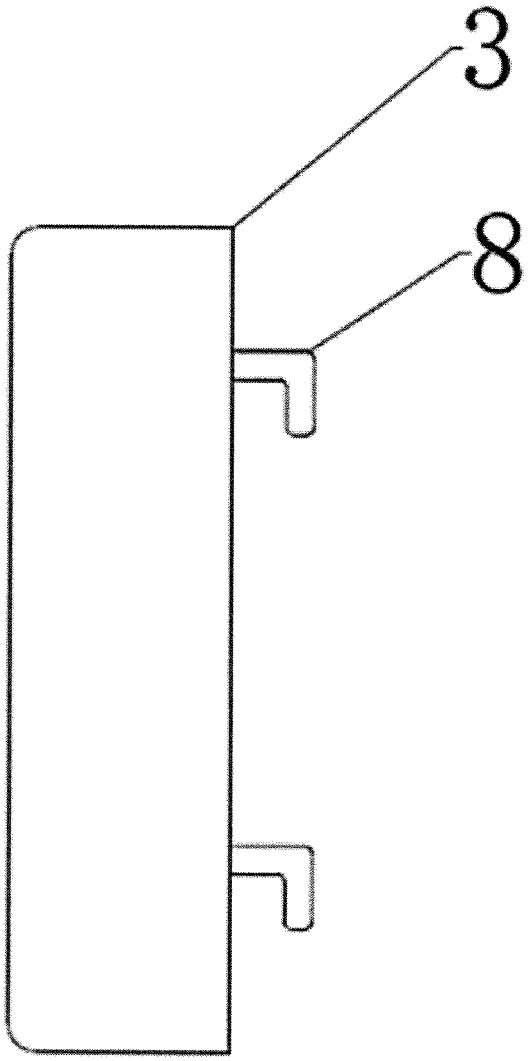
FIG. 3 is a partial enlarged view of a positioning slide block in the improved wheel pretreatment rack device of the present application.

As shown in FIGS. 1-3, the rack of the present application includes a hook 1, tripods 2, positioning slide blocks 3, positioning holes 4, a main rod 5, bearing rods 6, braces 7 and positioning clamping jaws 8. The main rod 5 is connected with two tripods 2, the main rod 5 is connected with two bearing rods 6 via the positioning slide blocks 3 in the direction perpendicular to planes determined by the tripods 2, the positioning slide blocks 3 are fixed on the main rod 5 by inserting the positioning clamping jaws 8 into the positioning holes 4, the hook 1 is arranged at the top of the main rod 5, and each tripod 2 is connected with two braces 7 in the direction perpendicular to plane determined by the tripod 2.

The bearing rods 6 are connected with the main rod 5 via the positioning slide blocks 3, the front sections of the bearing rods 6 tilt upward 130 degrees, the positioning slide blocks 3 are fixed in the positioning holes 4 of the main rod 5 via the positioning clamping jaws 8, and the positioning slide blocks 3 can be moved up and down according to the sizes of different wheels. The radii of the positioning holes are 8-10 mm, and the distance between two positioning holes is 10 mm.

When a wheel is cleaned, the central hole of the wheel is hung at the front ends of the bearing rods 6, and the bead seat of the wheel is placed on the braces 7 connected with the tripods 2. The wheel is fixed in a three-point positioning manner and prevented from dropping in the cleaning pretreatment process.

The pretreatment rack might meet the pretreatment requirement of wheels having different sizes by adjusting the positions of the positioning slide blocks up and down, effectively avoid the defects of drop, scratch and the like in the cleaning pretreatment process of wheels, and play an important role in improving the yield of wheels.

The foregoing descriptions of specific exemplary embodiments of the present application have been presented for purposes of illustration and description. They are not intended to be exhaustive or to limit the invention to the precise forms disclosed, and obviously many modifications and variations are possible in light of the above teachings. The exemplary embodiments were chosen and described in order to explain certain principles of the invention and their practical application, to thereby enable others skilled in the art to make and utilize various exemplary embodiments of the present invention, as well as various alternatives and modifications thereof. It is intended that the scope of the invention be defined by the Claims appended hereto and their equivalents.

What is claimed is:

1. An improved wheel pretreatment rack, comprising a hook, at least two tripods, positioning slide blocks, positioning holes, a main rod, at least two bearing rods, at least two braces and positioning clamping jaws, wherein the main rod is connected with two tripods, the main rod is connected with two bearing rods via the positioning slide blocks in a direction perpendicular to planes determined by the tripods, the positioning slide blocks are fixed on the main rod by inserting the positioning clamping jaws into the positioning holes, the hook is arranged at a top of the main rod, and each tripod is connected with two braces in the direction perpendicular to the plane determined by the tripod.

2. The improved wheel pretreatment rack of claim 1, wherein radii of the positioning holes are 8-10 mm; a distance between every two positioning holes is 5-10 mm; and front sections of the bearing rods tilt upward 125-135 degrees, the front sections means one ends which are not connected with the main rod.

3. The improved wheel pretreatment rack of claim 2, wherein radii of the positioning holes are 10 mm; a distance between every two positioning holes is 5 mm; and front sections of the bearing rods tilt upward 130 degrees.

* * * * *